US009416571B1

(12) United States Patent
McConnell

(10) Patent No.: US 9,416,571 B1
(45) Date of Patent: Aug. 16, 2016

(54) SWINGING DOUBLE GATE LATCH WITH A LOCK PIN

(71) Applicant: Bruce McConnell, Lincoln, CA (US)

(72) Inventor: Bruce McConnell, Lincoln, CA (US)

( * ) Notice: Subject to any disclaimer, the term of this patent is extended or adjusted under 35 U.S.C. 154(b) by 63 days.

(21) Appl. No.: 14/604,022

(22) Filed: Jan. 23, 2015

(51) Int. Cl.
*E05C 3/04* (2006.01)
*E05C 19/00* (2006.01)

(52) U.S. Cl.
CPC ..... *E05C 19/00* (2013.01)

(58) Field of Classification Search
CPC . E05C 65/0007; Y10S 292/13; Y10S 292/29; A01K 1/0017; E05Y 2900/40; E06B 11/021
USPC ..... 292/202, DIG. 13, DIG. 29
See application file for complete search history.

(56) References Cited

U.S. PATENT DOCUMENTS 1,538,056 A * 5/1925 Olson ..... E05B 65/0007 292/213
1,597,581 A * 8/1926 David-Moss ..... E05C 3/145 292/238
1,711,743 A * 5/1929 Olson ..... E05B 65/0007 292/198
3,647,250 A * 3/1972 Brown ..... E05C 5/00 292/238
4,447,081 A * 5/1984 Stottlemyre ..... E05B 73/0005 292/264
5,098,140 A * 3/1992 Kentner ..... E06B 11/021 292/205
5,103,658 A * 4/1992 McQuade ..... E05B 65/0007 49/394
5,593,141 A * 1/1997 Cain ..... A01K 1/0017 256/26
6,036,245 A * 3/2000 Schaefer ..... E05B 65/0007 292/119
8,544,149 B1 * 10/2013 Faber ..... E05D 7/12 16/256

* cited by examiner

*Primary Examiner* — Mark Williams
(74) *Attorney, Agent, or Firm* — Crossley and Stevenson Intellectual Property Law

(57) ABSTRACT

A swinging double gate latch with a lock pin including a vertical beam disposed on an end portion of a fence having a left side, a top side, and a bottom side. An outer mounting plate disposed on the beam left side proximal each of the top side and the bottom side, with an annular collar centrally disposed on each of the outer mounting plates. An inner mounting plate disposed on the beam left side disposed proximal each of the outer mounting plates. A pair of latches comprising an upper latch and a lower latch, with each of the upper latch and the lower latch further comprising a front flap and a rear stopper flap. A U-shaped mount having a pair of outer ends and center support therebetween disposed proximal the beam top side. A handle continuously engaging the mount center support and a continuous shaft rotationally engaging the collars.

1 Claim, 5 Drawing Sheets

SWINGING DOUBLE GATE LATCH WITH A LOCK PIN

BACKGROUND OF THE INVENTION

Various types of gate latches are known in the prior art. However, what is needed is a swinging double gate latch including a vertical beam disposed on an end portion of a fence, having a right side, a left side, a top side, a bottom side, a front side, and back side. What has further been needed is an outer mounting plate disposed on the left side of the vertical beam proximal each of the top side and the bottom side of the beam, with an annual collar centrally disposed on each of the outer mounting plates. In addition, what has been needed is an inner mounting plate disposed on the left side of the vertical beam proximal each of the outer mounting plates, a pair of latches comprising an upper latch and a lower latch, with each of the upper latch and the lower latch further comprising a front flap and a rear stopper flap, and a U-shaped mount having a pair of outer ends and a center support. Lastly, what has further been needed is a handle that pivotally engages the mount center support, a chain having a bottom end that is attached to the beam, and a locking pain on the chain that is configured to prevent the pivotal engagement of the handle with the mount center support.

FIELD OF THE INVENTION

The present invention relates to gate latches, and more particularly, to a swinging double gate latch with a lock pin.

SUMMARY OF THE INVENTION

The general purpose of the present swinging double gate latch with a lock pin, described subsequently in greater detail, is to provide a gate latch which has many novel features that result in a swinging double gate latch with a lock pin which is not anticipated, rendered obvious, suggested, or even implied by prior art, either alone or in combination thereof.

To accomplish this, the present swinging double gate latch with a lock pin comprises a vertical beam disposed on an end portion of a fence, the vertical beam having a right side disposed on the fence end portion, a left side, a top side, a bottom side, a front side, and a back side. An outer mounting plate is disposed on the left side of the vertical beam proximal each of the top side and the bottom side. An inner mounting plate is disposed on the left side of the vertical beam proximal each of the outer mounting plates in a position between the outer mounting plates. Each inner mounting plate has an exterior side and an interior side. An annular collar is centrally disposed on each of the outer mounting plates. A pair of latches comprises an upper latch and a lower latch, with each of the upper latch and the lower latch comprising a front flap and a rear stopper flap. Each of the rear stopper flaps has a front end and a rear end, with the rear end statically disposed on the interior side of the respective inner mounting plate. A U-shaped mount has a pair of outer ends and a center support therebetween that is disposed proximal the top side of the vertical beam. One of the outer ends is disposed on each of the front side and the back side of the vertical beam proximal the top side. A handle pivotably engages the center support on the U-shaped mount. A continuous shaft rotationally engages the collars. The continuous shaft is disposed between the front flap and the rear stopper flap and is in operational communication with the handle. The front flap is disposed on the shaft. A chain has a top end and a bottom end, and the bottom end is attached to the beam. A locking pin is disposed on the top end of the chain, and the locking pin is configured to prevent pivotal engagement of the handle with the center support of the U-shaped mount.

The latches have an open position and a closed position. The latches are in the open position when the front flap and the rear stopper flap are disposed perpendicular to each other. The latches are in the closed position when the end portion of a gate is disposed between the front flap and the rear stopper flap, and the front flap and the rear stopper flap are disposed parallel to each other.

Thus has been broadly outlined the more important features of the present swinging double gate latch with a lock pin so that the detailed description thereof that follows may be better understood and in order that the present contribution to the art may be better appreciated.

BRIEF DESCRIPTION OF THE DRAWINGS

Figures

DETAILED DESCRIPTION OF THE DRAWINGS

Figure 1:
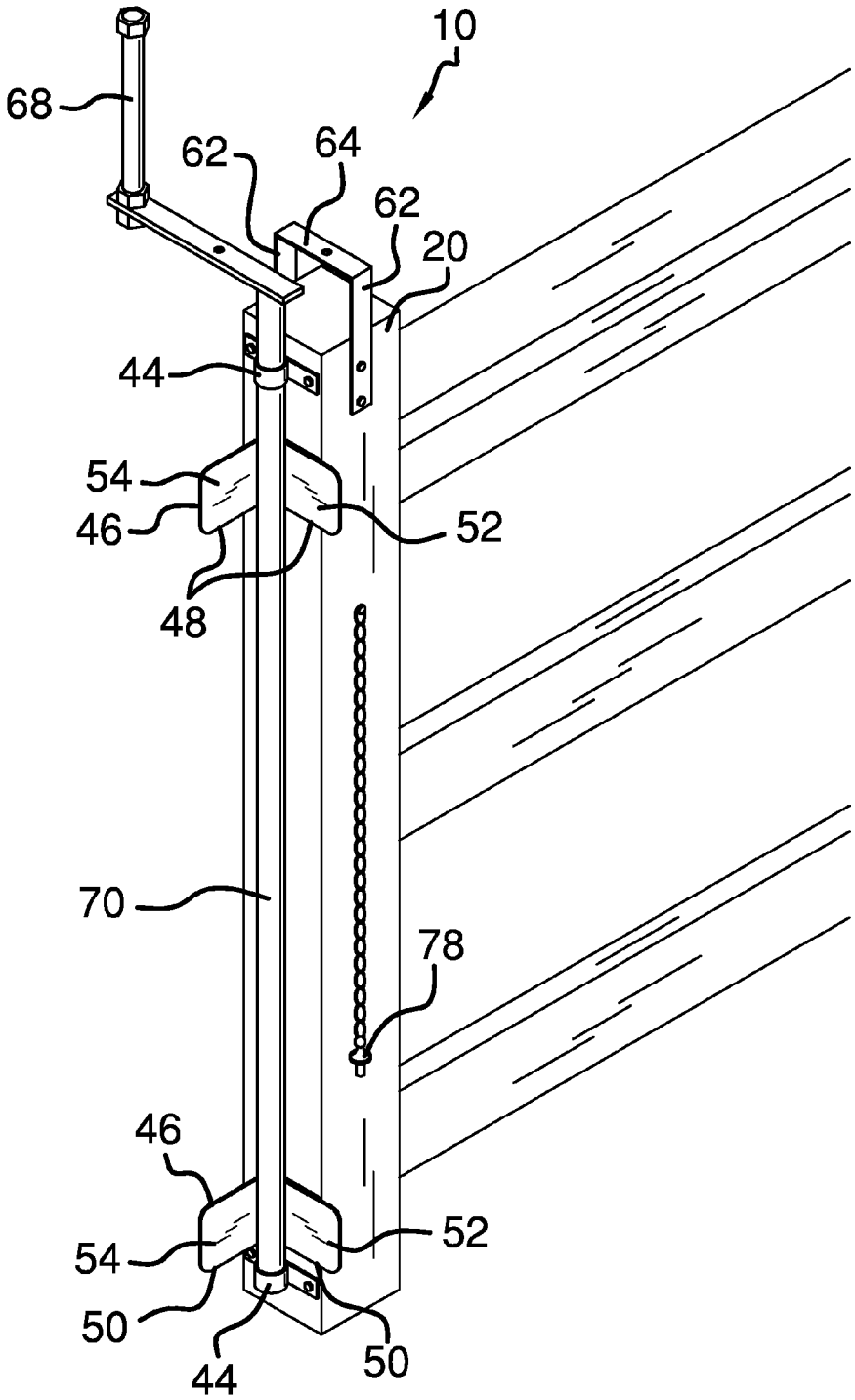
FIG. 1 is a front isometric view showing the latches in an open position.

With reference now to the drawings, and in particular FIGS. 1 through 5 thereof, an example of the instant swinging double gate latch with a lock pin employing the principles and concepts of the present swinging double gate latch with a lock pin and generally designated by the reference number 10 will be described.

Referring to FIGS. 1 through 5, the present swinging double gate latch with a lock pin 10 is illustrated. The swinging double gate latch with a lock pin 10 includes a vertical beam 20 disposed on an end portion of a fence 22. The vertical beam 20 has a right side 24 disposed on the end portion of the fence 22, a left side 26, a top side 28, a bottom side 30, a front side 32, and a back side 34. An outer mounting plate 36 is disposed on the left side 26 of the vertical beam 20 proximal each of the top side 28 and the bottom side 30. An inner mounting plate 38 is disposed on the left side 26 of the vertical beam 20 proximal each of the outer mounting plates 36 in a position between the outer mounting plates 36. Each of the inner mounting plates has an exterior side 40 and an interior side 42. An annular collar 44 is centrally disposed on each of the outer mounting plates 36. A pair of latches 46 comprises an upper latch 48 and a lower latch 50, with each of the upper latch 48 and the lower latch 50 further comprising a front flap 52 and a rear stopper flap 54. Each of the rear stopper flaps 54 has a front end 56 and a rear end 58, with the rear end 58 statically disposed on the interior side 42 of the respective inner mounting plate 38. A U-shaped mount 60 has a pair of outer ends 62 and a center support 64 therebetween disposed proximal the top side 28 of the vertical beam 20. One of the outer ends 66 is disposed on each of the front side 32 and the back side 34 of the vertical beam 20 proximal the top side 28. A handle 68 pivotably engages the center support 64 of the U-shaped mount 60. A continuous shaft 70 rotationally engages the collars 44, and the shaft 70 is disposed between the front flap 52 and the rear stopper flap 54. The shaft 70 is in operational communication with the handle 68. The front flap 52 is disposed on the shaft 70. A chain 72 has a top end 74 and a bottom end 76. The bottom end 76 is attached to the vertical beam 20. A locking pin 78 is disposed on the top end 74 of the chain 72, and the locking pin is configured to prevent pivotal engagement of the handle 68 with the center support 64 of the U-shaped mount 60.

Figure 2:
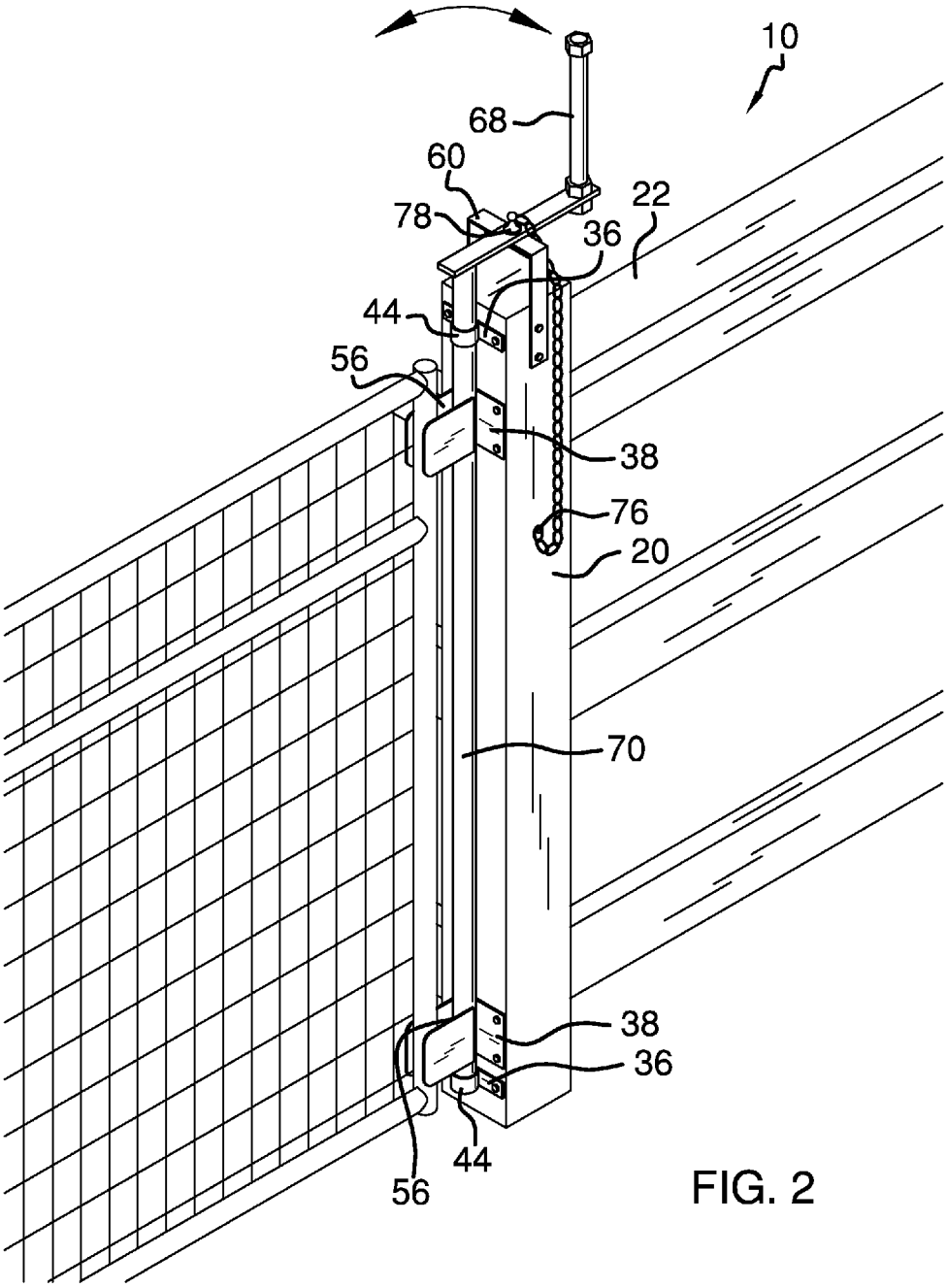
FIG. 2 is a front isometric view showing the latches in a closed position.
Figure 3:
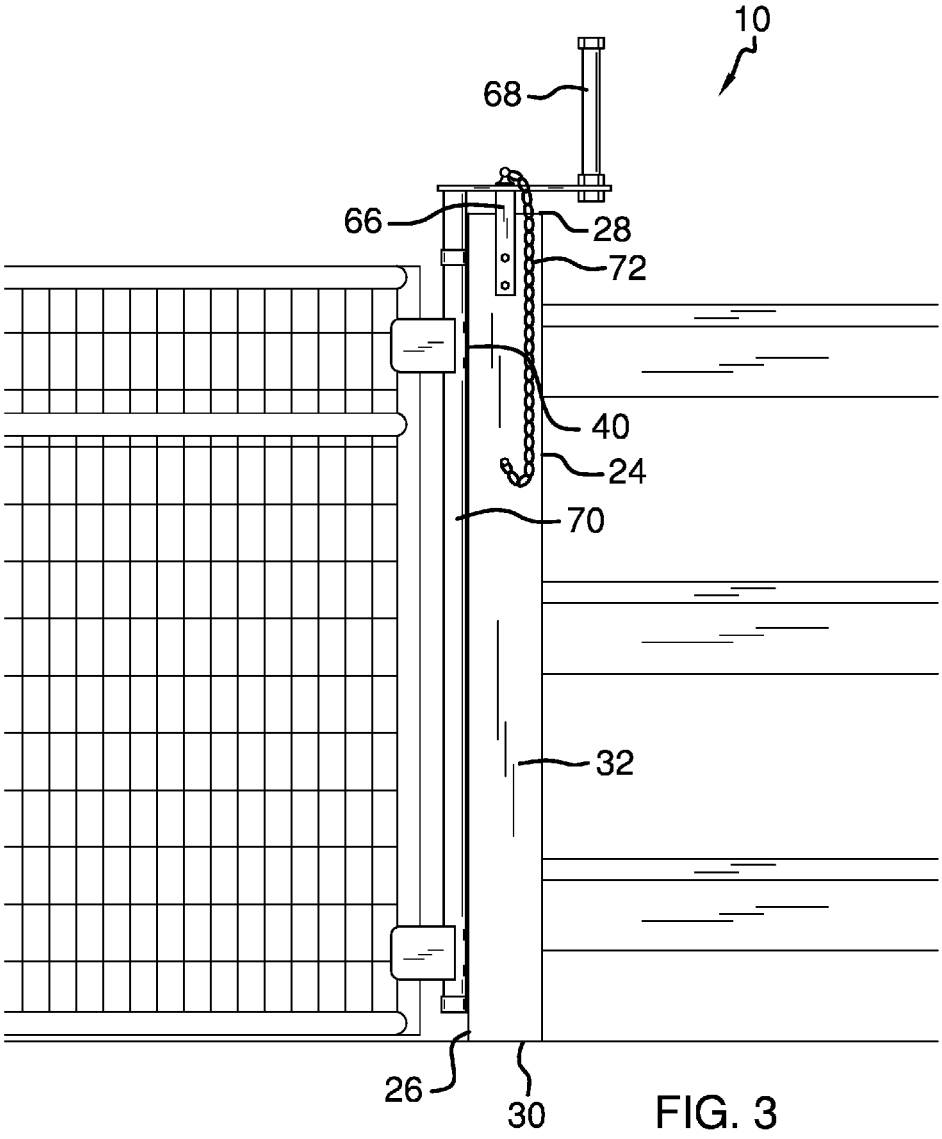
FIG. 3 is a front elevation view showing the latches in a closed position.
Figure 4:
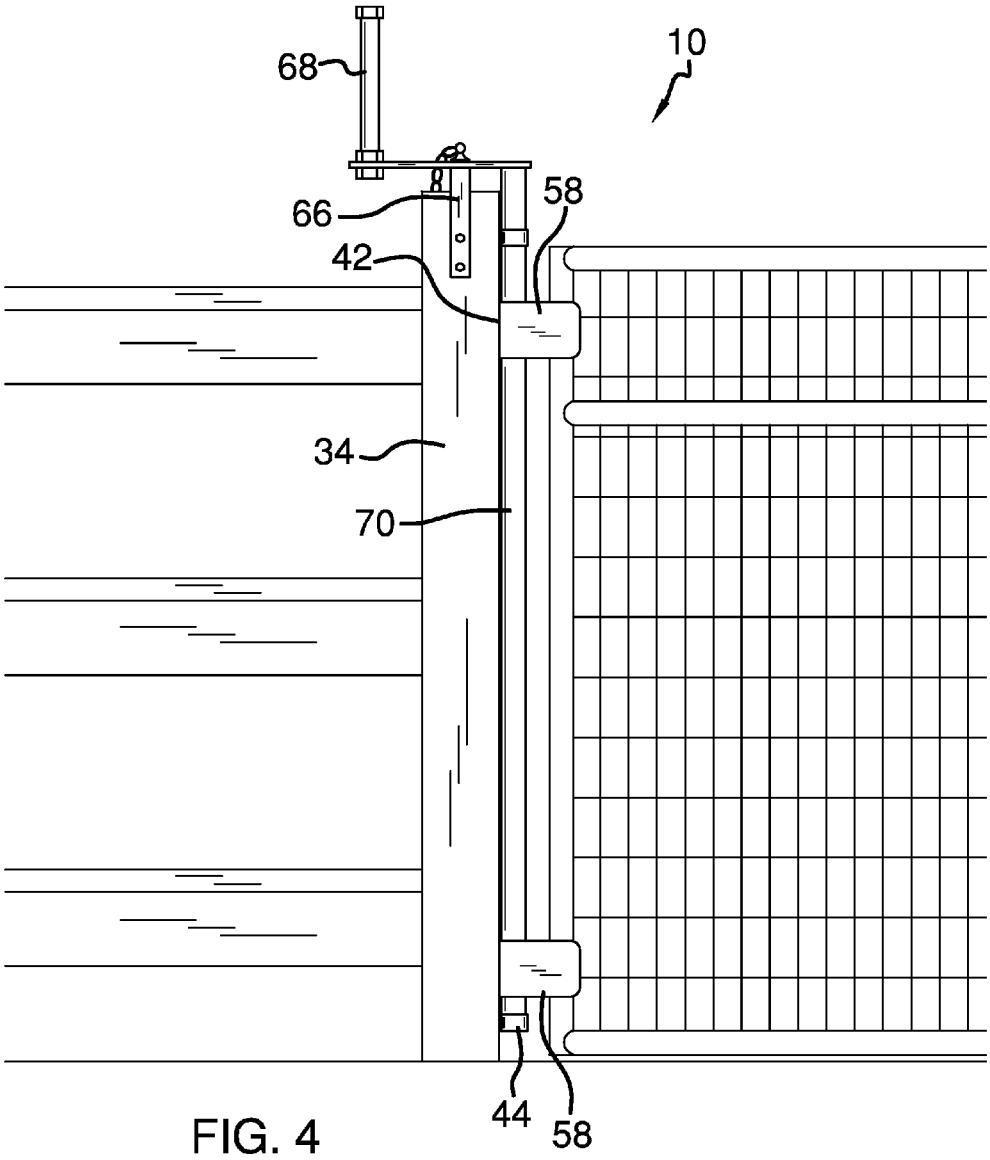
FIG. 4 is a back elevation view showing the latches in a closed position.
Figure 5:
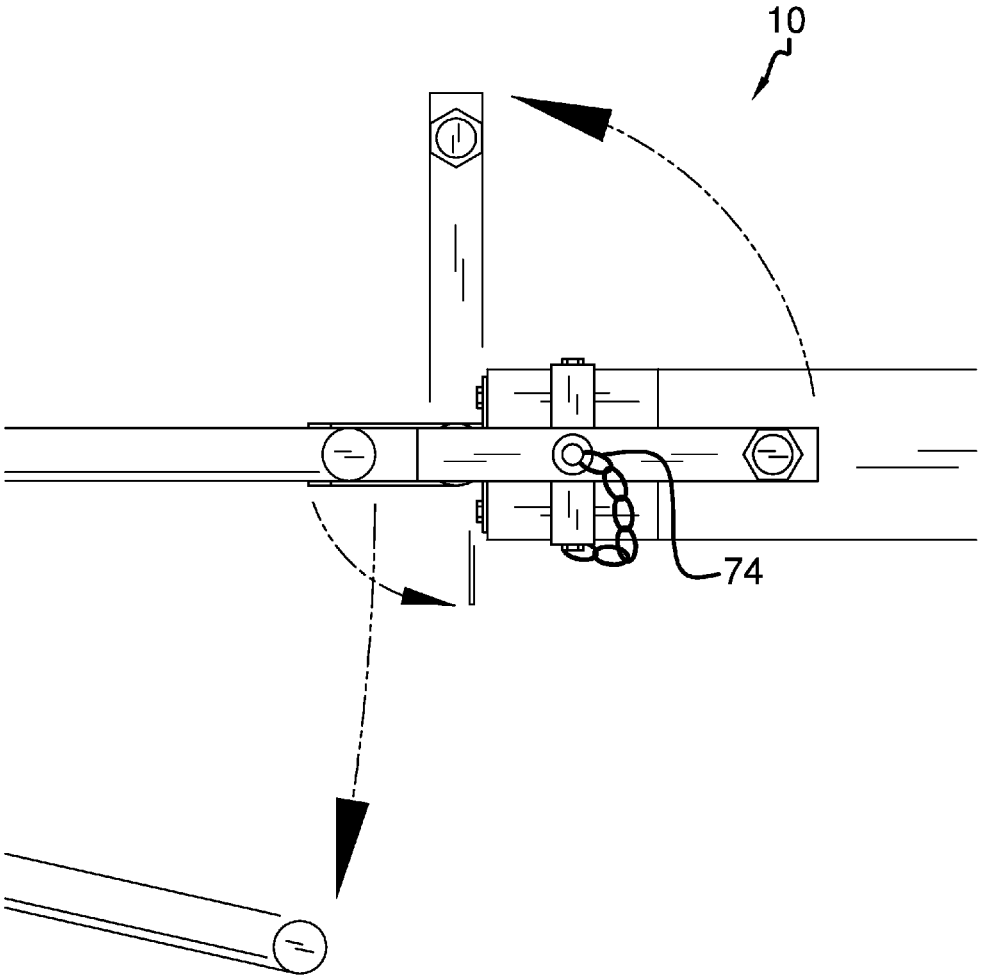
FIG. 5 is a top plan view.

As best shown in FIG. 1, the latches 46 have an open position. As best shown in FIG. 2, the latches 46 have an alternate closed position.

What is claimed is:

1. A swinging double gate latch with a lock pin, said gate latch comprising:

a vertical beam disposed on an end portion of a fence, the vertical beam having a right side disposed on the fence end portion, a left side, a top side, a bottom side, a front side, a back side;

two outer mounting plates, each outer mounting plate disposed on the vertical beam left side, one outer mounting plate being proximal the top side and the other outer mounting plate being proximal the bottom side;

two inner mounting plates, each inner mounting plate disposed on the vertical beam left side and each inner mounting plate being disposed proximal each of the outer mounting plates in a position between the outer mounting plates respectively, each inner mounting plate having an exterior side and an interior side;

two annular collars, each annular collar centrally disposed on each of the outer mounting plates respectively;

a pair of latches comprising an upper latch and a lower latch, each of the upper latch and the lower latch comprising: a front flap; a rear stopper flap, each rear stopper flap having a front end and a rear end, the rear end statically disposed on the interior side of the respective inner mounting plate;

a U-shaped mount having a pair of outer ends and a center support there between disposed proximal the vertical beam top side, one of the outer ends disposed on each of the front side and the back side of the vertical beam proximal the top side;

a handle pivotably engaging the mount center support;

a continuous shaft rotationally engaging the collars, the shaft disposed between the front flap and the rear stopper flap, the shaft being in operational communication with the handle;

a chain having a top end and a bottom end, wherein the bottom end is attached to the beam;

a locking pin disposed on the top end of the chain, wherein the locking pin is configured to prevent pivotal engagement of the handle with the mount center support; wherein the front flap is disposed on the shaft;

wherein the pair of latches has an open position and a closed position;

wherein the pair of latches is in the open position when the front flap and the rear stopper flap are disposed perpendicular to each other;

wherein the pair of latches is in the closed position when the end portion of a gate is disposed between the front flap and the rear stopper flap, and the front flap and the rear stopper flap are disposed parallel to each other.

* * * * *